US006604460B2

(12) United States Patent
Watanabe

(10) Patent No.: US 6,604,460 B2
(45) Date of Patent: Aug. 12, 2003

(54) STENCIL PRINTING MACHINE AND METHOD OF CONTROLLING THE SAME

(75) Inventor: Hiroshi Watanabe, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 171 days.

(21) Appl. No.: 09/846,319

(22) Filed: May 2, 2001

(65) Prior Publication Data

US 2001/0042457 A1 Nov. 22, 2001

(30) Foreign Application Priority Data

May 19, 2000 (JP) ..... P2000-147598

(51) Int. Cl.[7] ..... B41L 13/00
(52) U.S. Cl. ..... 101/119; 101/116; 101/129
(58) Field of Search ..... 101/116, 117, 101/118, 119, 120, 129

(56) References Cited

U.S. PATENT DOCUMENTS 4,905,595 A * 3/1990 Jeschke ..... 101/174
5,165,338 A * 11/1992 Okazaki et al. ..... 101/118
5,443,557 A * 8/1995 Hasegawa ..... 101/119
5,632,200 A * 5/1997 Fukai ..... 101/116
5,671,670 A * 9/1997 Takahashi et al. ..... 101/116
6,038,968 A * 3/2000 Hara et al. ..... 101/116
6,067,902 A * 5/2000 Takahashi ..... 101/118
6,234,076 B1 * 5/2001 Mizutani et al. ..... 101/118
6,283,021 B1 * 9/2001 Watanabe et al. ..... 101/127

FOREIGN PATENT DOCUMENTS

EP 0 653 310 5/1995
JP 10-000846 1/1998

* cited by examiner

*Primary Examiner*—Daniel J. Colilla
*Assistant Examiner*—Jill E Culler
(74) *Attorney, Agent, or Firm*—Nath & Associates PLLC; Marvin C. Berkowitz; Sheldon M. McGee

(57) ABSTRACT

A stencil printing machine and a control method is provided wherein first and second printing drums 25 and 26 are rotatably supported in close proximity to an outer periphery of a press drum 27 at positions spaced by a given angle, wherein outer circumferential peripheral walls of the first and second printing drums 25 and 26 carry stencil clamping bases 28, respectively, and inner press rollers 33 are located inside the printing drums 25 malid 26, respectively. During printing operation, the printing drums 25 and 26 are rotated with a rotational phase angle of 180 degrees relative to the press drum and, at termination of printing operation, the printing drums 25 and 26 are stopped at respective stationary rest positions which are out of ink stain zones of respective printing drums.

9 Claims, 6 Drawing Sheets

STENCIL PRINTING MACHINE AND METHOD OF CONTROLLING THE SAME

BACKGROUND OF THE INVENTION

1. Field of the Invention

The present invention relates to stencil printing machines and more particularly to a stencil printing machine equipped with plural printing drums for achieving a multi-color printing and a method of controlling the same.

2. Description of the Related Art

Various research and development work has been undertaken to provide an improved stencil printing, a typical example of which is disclosed in FIG. 6 which shows a part of a structure of the earlier stencil printing machine. In FIG. 6, first and second printing drums 101 and 102 and a press drum 103 are rotatably supported in a frame body (not shown) such that the first and second printing drums 101 and 102 are located in close proximity to an outer periphery of the press drum 103 at positions angled at 90 degrees of a central angle of the press drum 103. Outer circumferential peripheries of the respective first and second printing drums 101 and 102 carry thereon stencil clamping bases 101*a* and 102*a*, respectively, which support thereon sheet clamping segments 101*b* and 102*b* for clamping stencil sheets (not shown) onto the stencil clamping bases 101*a* and 102*a*, respectively.

Further, screens 105 are wound on the outer circumferential peripheries of the first and second printing drums 101 and 102 in a stretched state with the use of the stencil clamping bases 101*a* and 102*a* and springs 104, with each of the screens 105 being formed of a mesh structure which allows printing ink to permeate. Inner press rollers 106 and 107, which serve as ink supply rollers, respectively, are located inside the screens 105 of the first and second printing drums 101 and 102, respectively, with the inner press rollers 106 and 107 being moveable between a wait position not to press the screens 105 and a press engagement position to press the screens 105.

During printing operation, the inner press rollers 106 and 107 are maintained in the press engagement position, in which the screens 105 are expanded outward. Also, it is arranged such that the screen 105 of the first printing drum 101 is supplied with printing ink in a first color by the inner press roller 106 and the screen 105 of the second printing drum 102 is supplied with printing ink in a second color by the inner press roller 107. The outer circumferential periphery of the press drum 103 is provided with a print sheet clamping segment 109, for clamping a leading edge of a print sheet 108, which clamps the leading edge of the print sheet 108 transferred from a paper feed section 110 and release the leading edge of the print sheet 108 at a position in the vicinity of an inlet portion of a sheet discharge section 111.

Now, the stencil printing machine thus arranged operates as follows. A leading edge of a first stencil sheet, which has been made on the basis of image data in a first color of an original is clamped with the sheet clamping segment 101*b* of the first printing drum 101, and a leading edge of a second stencil sheet, which has been made on the basis of image data in a second color of the original, is clamped with the sheet clamping segment 102*b* of the second printing drum 102, with the stencil sheets being mounted onto the outer circumferential peripheries of the respective screens 105. Next, the first and second printing drums 101 and 102 and the press drum 103 are rotated in synchronism with one another in directions as shown by arrows in FIG. 6, thereby causing the print sheet 108 to be transferred between the first printing drum 101 and the press drum 103 from the paper feed section 110. The print sheet 108 thus transferred is clamped with the print sheet clamping segment 109 of the press drum 103, allowing the print sheet to pass along the outer circumferential periphery of the press drum 103 between the first printing drum 101 and the press drum 103.

During this passing step of the print sheet, the inner press roller 106 is brought into press engagement with the screen 105 of the first printing drum 101 which is consequently expanded outward, allowing printing ink to be transferred to the print sheet 108 to reproduce a desired image pattern with a first color via a perforated image area of the first stencil sheet. The print sheet 108, which has passed between the first printing drum 101 and the press drum 103, then passes between the second printing drum 102 and the press drum 103. During this passing step of the print sheet, the inner press roller 107 is brought into press engagement with the second screen 105 which is consequently expanded outward, allowing printing ink to be transferred to the print sheet 108 to reproduce a desired image pattern with a second color. As the sheet clamping segment 109 of the press drum 103 is rotated to a position near the inlet of the sheet discharge section 111, the sheet clamping segment 109 is released, with the released print sheet 108 being discharged to the given discharge position by the sheet discharge section 111. In this manner, two-color printing is completed.

SUMMARY OF THE INVENTION

As noted above, the first and second printing drums 101 and 102 are located at the rotational positions spaced by 90 degrees of central angle of the press drum 103, in which the first and second printing drums 101 and 102 are rotated with the rotational phase angle of 180 degrees such that the respective printing positions of the first and second printing drums 101 and 102 are aligned with one another relative to the press drum 103. As a consequence, the stationary rest positions of the respective printing drums 101 and 102 are kept in opposing positions of 180 degrees at the termination of the printing operation.

By the way, in the earlier practices, since no consideration has been undertaken to the rotational stop positions of the respective printing drums 101 and 102 at the termination of the printing operation, when, for example, the first printing drum 101, which is one of the printing drums, is stopped at the stationary rest position in an upper area, the second printing drum 102, which is the other remaining printing drum, is caused to stop at the stationary rest position located in a lower area, with this stationary rest position being left until the start of next printing operation.

On the other hand, in the event ink pools are located at upper circumferential positions of the respective inner press rollers 106 and 107 and supply printing ink to the inner press rollers 106 and 107, the printing ink is liable to gradually flow downward in a long time period along the respective outer peripheries of the inner press rollers 106 and 107. Consequently, when the stencil clamping bases 101*a* and 102*a* remain at the lower positions, the dropped printing ink.flows through a gap between the each screen 105 and each stencil clamping base 101*a* or 102*a* onto a surface of each stencil clamping base 101*a* or 102*a*, causing that surface to be stained with the printing ink.

The present invention has been made to address various issues encountered in the earlier practices and has an object of the present invention to provide a stencil printing machine which can prevent stains with printing ink as little as possible in a stationary rest position of each printing drum.

According to a first aspect of the present invention, there is provided a stencil printing machine having a frame body, which comprises a press drum rotatably supported in the frame body, a plurality of printing drums rotatably supported in the frame body in close proximity to the press drum and each including an outer circumferential periphery having a first portion formed with a stencil clamping base, which has a stencil clamping segment and a second remaining portion formed with an ink permeable member, and a plurality of ink supply rollers located inside the printing drums, respectively, for supplying ink to respective inner peripheral surfaces thereof. During printing operation, the plurality of printing drums are rotated with a given rotational phase angle relative to the press drum, and the ink supply rollers are rotated to supply ink to the inner peripheral surfaces of the respective printing drums. At termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

According to a second aspect of the present invention, there is provided a stencil printing machine which comprises a frame body, a press drum rotatably supported in the frame body, a plurality of printing drums rotatably supported in the frame body in close proximity to the press drum and each including an outer circumferential periphery having a first portion formed with a stencil clamping base, which has a stencil clamping segment, and a second remaining portion formed with an ink permeable member, a stencil making unit supported in the frame body for making stencil sheets each having a perforated image area formed on the basis of a color original, with the stencil sheets being supplied to and mounted onto the outer circumferential peripheries of the respective printing drums, and a plurality of ink supply rollers located inside the printing drums, respectively, for supplying ink to respective inner peripheral walls thereof. During printing operation, the plurality of printing drums are rotated with a given rotational phase angle relative to the press drum, and the ink supply rollers are rotated to supply ink to the inner peripheral walls of the respective printing drums. At termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

According to a third aspect of the present invention, there is provided a method of controlling a stencil printing machine having a press drum rotatably supported in a frame body, a plurality of printing drums rotatably supported in the frame body in close proximity to the press drum and each including an outer circumferential periphery having a first portion formed with a stencil clamping base, which has a stencil clamping segment, and a second remaining portion formed with an ink permeable member, and a plurality of ink supply rollers located inside the printing drums, respectively, for supplying ink to inner peripheral walls of the respective printing drums, and a main motor for driving the press drum and the plurality of printing drums. The method comprises rotating the press drum and the plurality of printing drums with the main motor, making stencil sheets each having a perforated image area formed on the basis of an original, mounting the stencil sheets onto the printing drums, supplying ink to the plurality of printing drums, supplying a print medium between the printing drums and the press drum to allow ink to be transferred from the printing drums through the perforated image areas thereof to the print medium to reproduce a desired image thereon. During printing operation, the plurality of printing drums are rotated by the main motor with a given rotational phase angle relative to the press drum and the ink supply rollers are rotated to supply ink to the inner peripheral walls of the respective printing drums.

At termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

BRIEF DESCRIPTION OF THE DRAWINGS

The invention, together with objects and advantages thereof, may best be understood by reference to the following description of the presently preferred embodiments together with the accompanying drawings, in which.

DETAILED DESCRIPTION OF THE PREFERRED EMBODIMENTS STRUCTURE OF STENCIL PRINTING MACHINE

Figure 1:
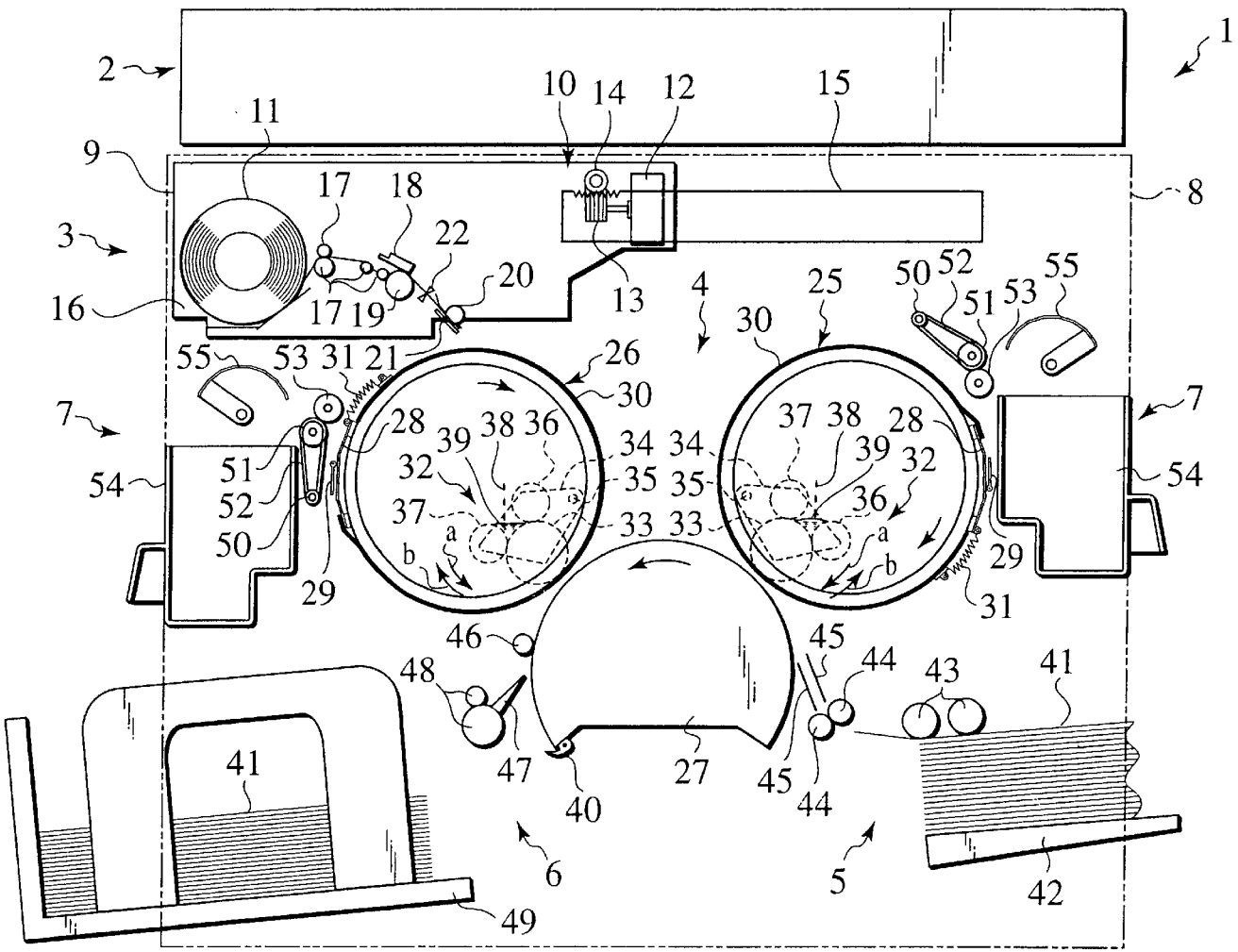
FIG. 1 a schematic structural view of a first preferred embodiment of a stencil printing machine according to the present invention.
Figure 2:
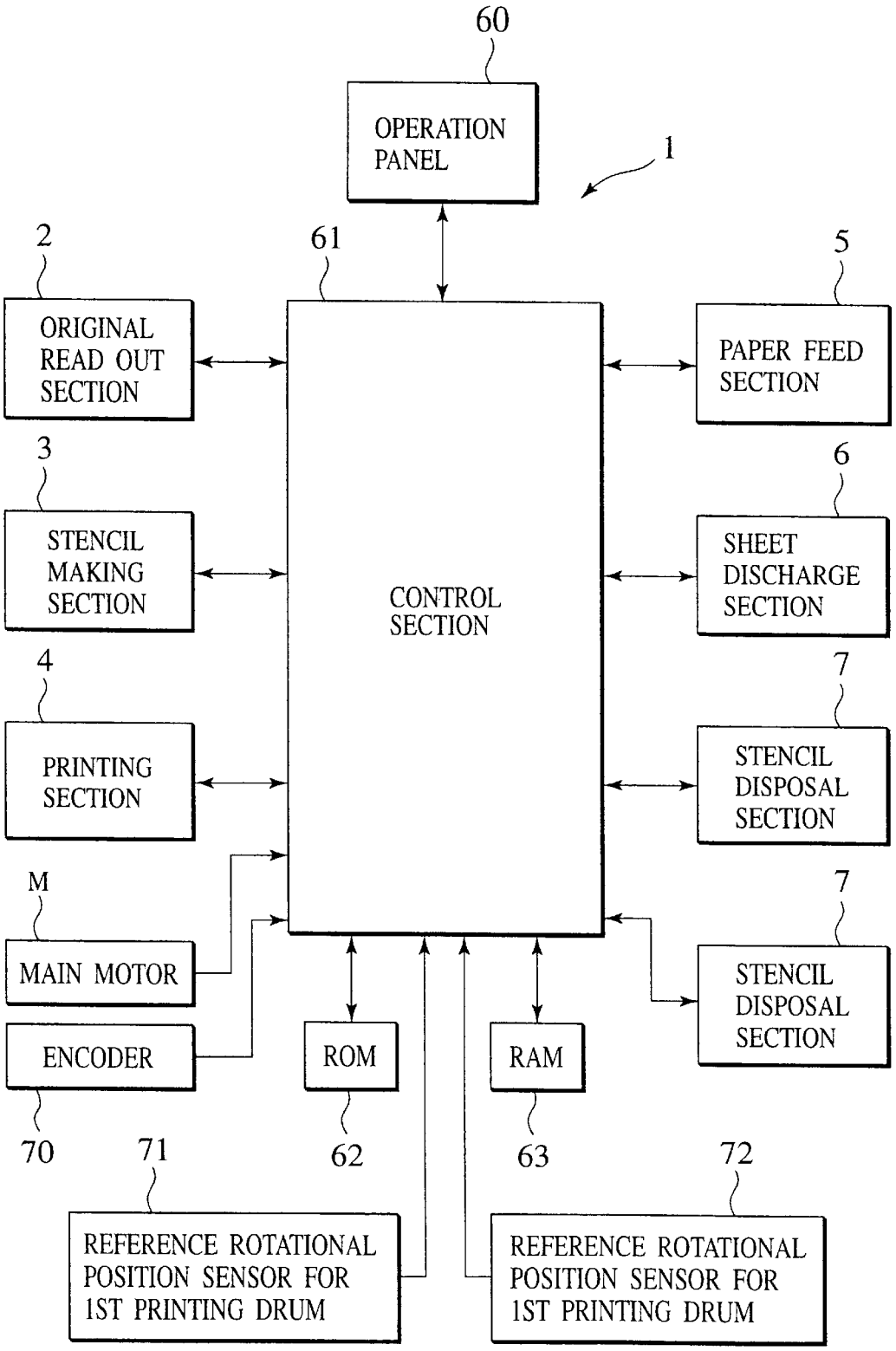
FIG. 2 a block diagram of a schematic electric circuit of the first preferred embodiment of the stencil printing machine according to the present invention.
Figure 3:
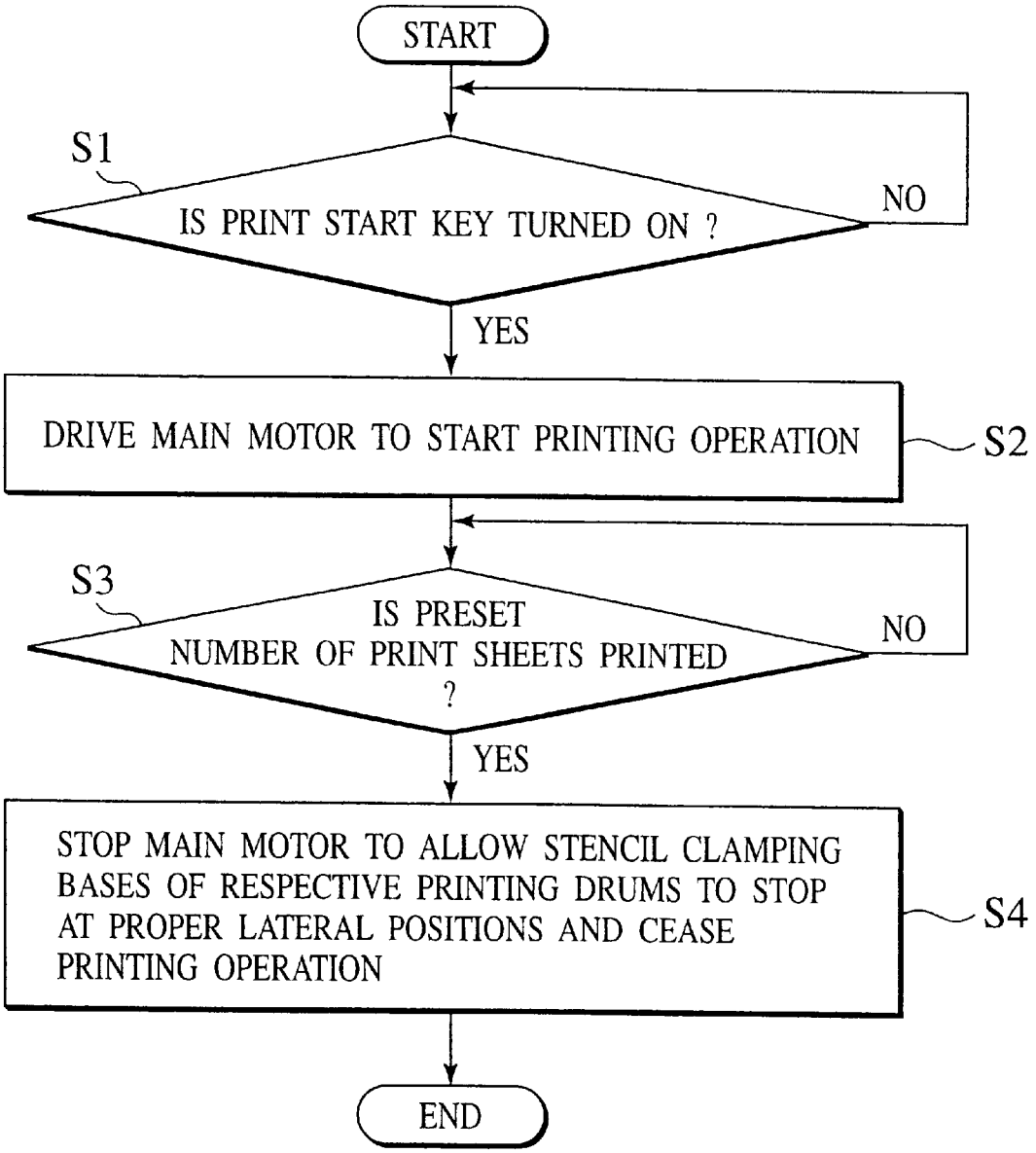
FIG. 3 is a general flow diagram for illustrating the basic sequence of operations of the stencil printing machine according to the present invention.
Figure 4:
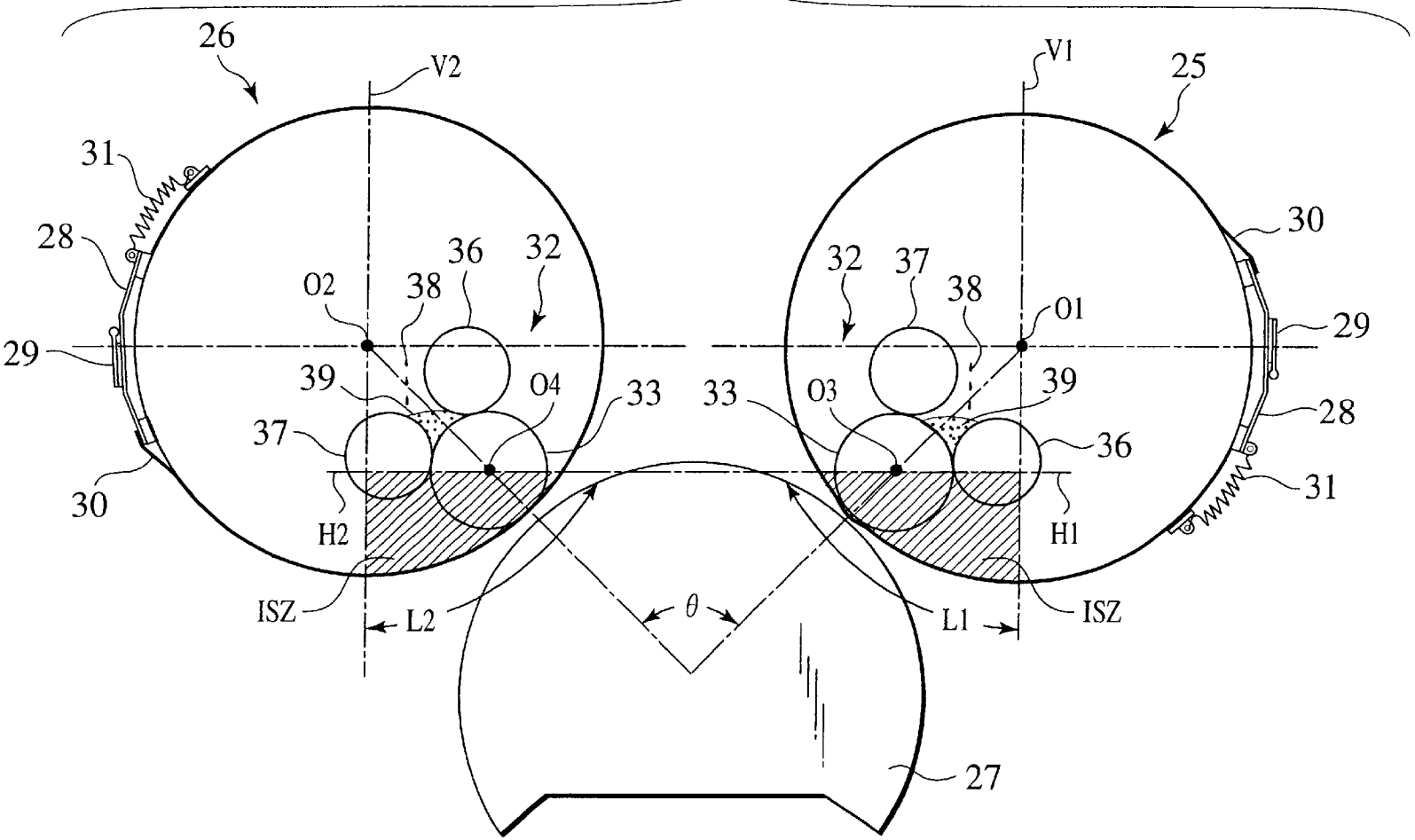
FIG. 4 is a schematic enlarged view of the stencil printing machine, illustrating a part of a structure thereof wherein first and second printing drums are held in respective stationary rest positions at termination of printing operation.
Figure 5:
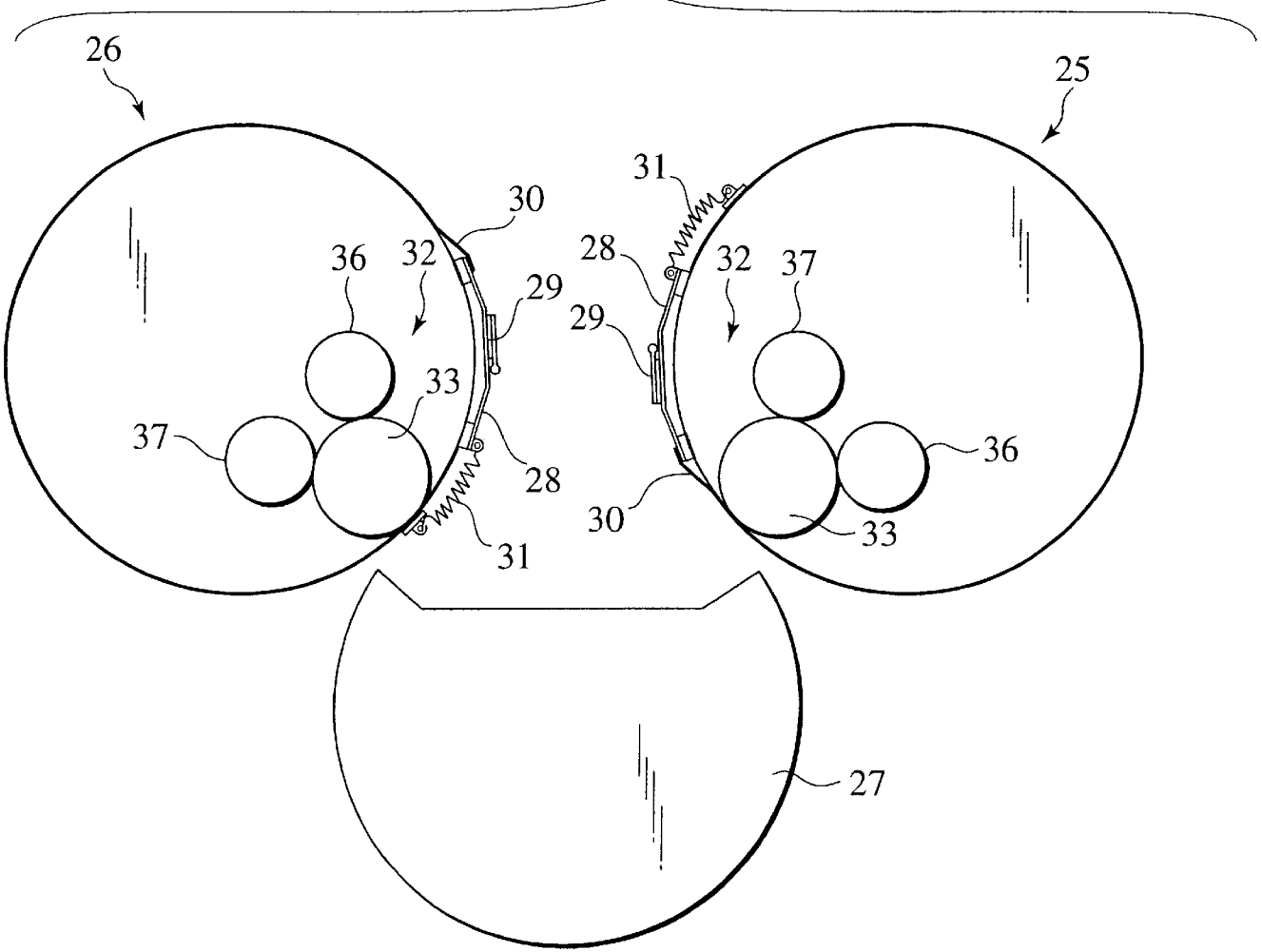
FIG. 5 is a schematic enlarged view of a second preferred embodiment of a stencil printing machine according to the present invention, illustrating a part of a structure thereof wherein first and second printing drums are held in respective stationary rest positions at termination of printing operation.
Figure 6:
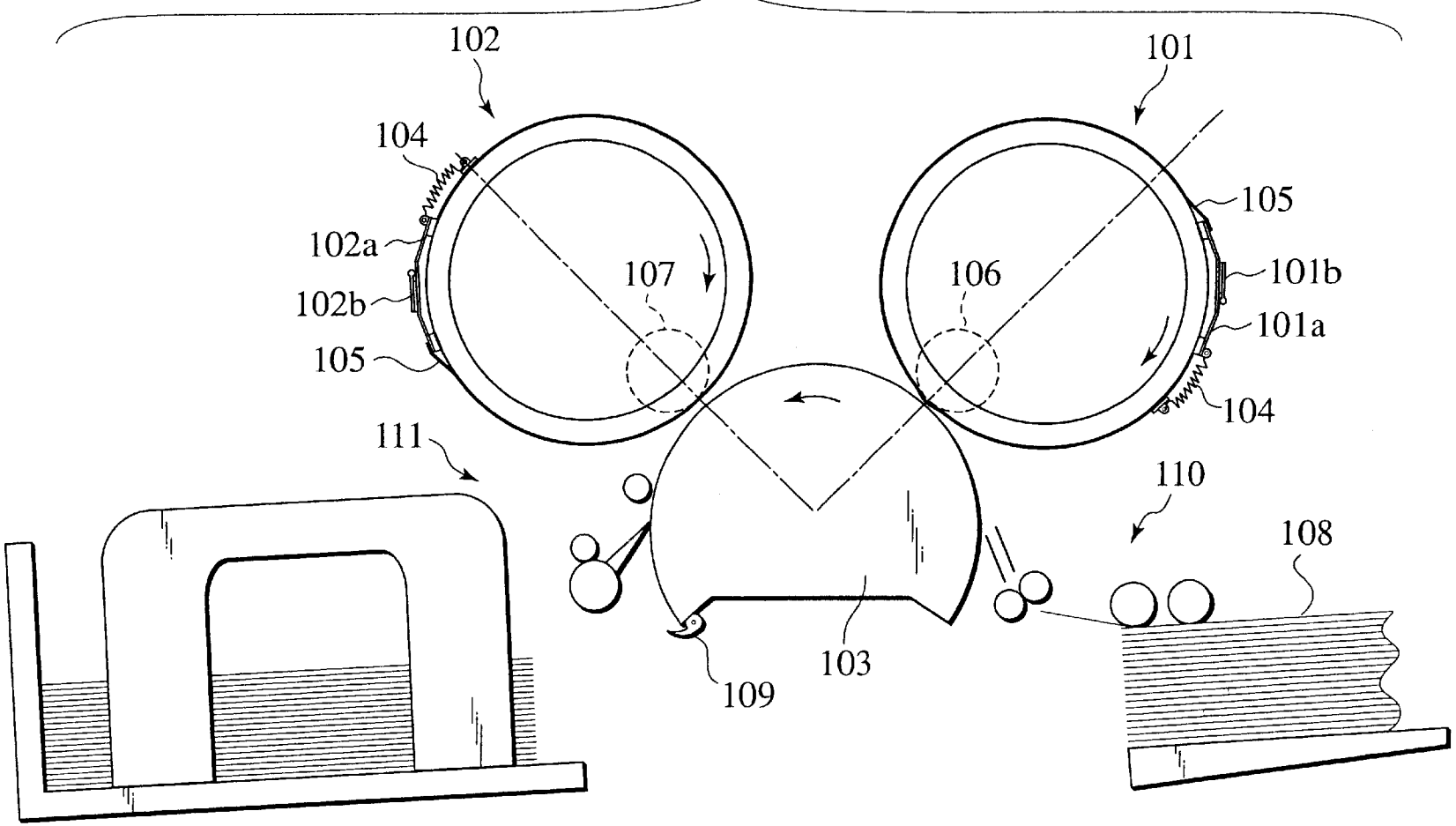
FIG.6 PRIOR ART
FIG. 6 is a schematic structural view of an earlier stencil printing machine.

Referring to FIGS. 1 to 5, there is shown a first preferred embodiment of a stencil printing machine according to the present invention, wherein FIG. 1 is a schematic structural view of the stencil printing machine 1, FIG. 2 is a schematic, circuit block diagram of the stencil printing machine 1, FIG. 3 is a general flow diagram for illustrating the basic sequence of operations which are executed when a single-color printing mode is selected, FIG. 4 is an enlarged schematic view of certain components of the stencil printing machine, illustrating first and second printing drums being located at respective stationary rest positions at termination of printing operation, and FIG. 5 is an enlarged schematic view of certain components of a second preferred embodiment of a stencil printing machine, illustrating another example of stationary rest positions of the first and second printing drums.

In FIG. 1, the stencil printing machine 1 is mainly constructed of an original reader section 2, a stencil making section 3, a printing section 4, a paper feed section 5, a sheet discharge section 6, and stencil disposal sections 7 mounted at two locations, and functions to operate in a first single-color printing mode and a second two-color printing mode.

ORIGINAL READER SECTION

The original reader section 2 is located above a frame body 8 and reads an image pattern, as input image data of an original to produce a train of electric signals. The train of electric signals is processed to produce output image data signals to be reproduced in printing ink with first and second colors for first and second printing drums. Also, in this event, the output image data signals can be further processed on the basis of given commands (i.e., commands for scale up or scale down, etc.).

STENCIL MAKING SECTION

The stencil making section 3 includes a stencil making unit 9 located in an upper portion of the frame body 8 for horizontal movement. The stencil making-unit 9 is moveable with a stencil making unit transfer device 10 between a first stencil sheet feeder position to allow a first perforated stencil sheet 11 to a first printing drum 25 and a second stencil sheet feeder position (i.e., a position shown in FIG. 1) to allow a second non-perforated stencil sheet 11 to a second printing drum 26. The stencil making-unit transfer device 10 is constructed having a stencil making-unit transfer motor 12, a worm gear 13 fixed to a rotary shaft of the stencil sheet making-unit transfer motor 12, a worm wheel (not shown) meshing with the worm gear 13, a pinion gear 14 connected to the worm wheel at an central axis thereof, and a rack 15 fixedly mounted to the machine frame 8. The stencil making unit 9 includes a stencil sheet roll container 16 which receives an elongated stencil sheet 11-formed in a rolled shape, a plurality of feed rollers 17 adapted to guide a leading edge of the stencil sheet 11 received in the stencil sheet roll container 16 toward a downstream side, a thermal printing head 18 located at a downstream side of the feed rollers 17, a platen roller 19 which is located in an opposed position of the thermal printing head 18 and which rotates with drive force exerted by a pulse motor (not shown), a stencil sheet feed roller 20 located at a downstream side relative to the platen roller 19 and the thermal printing head 18 and adapted to be driven with the drive force of the pulse motor, a guide plate 21 to which the stencil sheet feed roller 20 is held in contact in a pressurized relationship, and a stencil sheet cutter 22 located between the stencil sheet feed roller 20 and the guide plate 21, and the platen roller 19 and the thermal printing head 18.

PRINTING SECTION

The printing section 4 includes a first printing drum 25, a second printing drum 26, and a press drum 27, which serves as a rotary printing press member to impart printing pressure, with both the first and second printing drums 25 and 26 being located above the press drum 27 in right and left directions at obliquely oriented positions. In particular, the first and second printing drums 25 and 26 are placed in close proximity to an outer circumferential periphery of the press drum 27 at positions angled 90 degrees relative to a central axis of the press drum 27. The first and second printing drums 25 and 26 and the press drum 27 are rotatably supported in the frame body 8, and are rotated with a printing drum rotating mechanism (not shown) at the same circumferential speeds, as shown by arrows in FIG. 1, in the vicinities of a first contact zone between the first printing drum 25 and the press drum 27 and a second contact zone between the second printing drum 26 and the press drum 27. The printing drum rotating mechanism is driven with a main motor (not shown) which serves as a drive source.

The first and second printing drums 25 and 26 have respective annular frame pairs (bearing no reference numerals) which are interconnected with stencil clamping bases 28, forming respective parts of outer circumferential peripheries of the first and second printing drums 25 and 26, respectively. The stencil clamping bases 28 have respective stencil clamping segments 29, by which leading edges of the stencil sheets 11 are clamped. Also, leading edges of screens 30, which form respective outer circumferential peripheries of the first and second printing drums 25 and 26 and which serve as ink permeable members, are fixed to the stencil clamping bases 28, with each screen 30 being wound on each of outer circumferential peripheries of the first and second printing drums 25 and 26.

An end portion of each screen 30 is stretched over each of the stencil clamping bases 28 by a spring 31, with each screen 30 being arranged to be expandable outward against the force of the spring 31. Each screen 30 is constructed of, for example, a mesh-shaped porous structure which, when it is pressed with an inner press roller 33, which serves as an ink supply roller as will be discussed below, permits printing ink 38 to permeate from inward to outward. Thus, the circumferential peripheries of the first and second printing drums 25 and 26 are formed with the ink permeable screens 30.

Inside each of the screens 30 of the first and printing drums 25 and 26, an inner press mechanism 32 is accommodated. Each inner press mechanism 32 includes the inner press roller 33 which has a first function in that the screen 30 is pressed from inside for printing, and a second function in that the printing ink 38 is supplied to the screen 30.

Each of the inner press rollers 33 is rotatably supported by a pair of roller support members 34 located at both sides of each press roller and is rotated with a drive means, which is not shown, in synchronism with rotations of the first and second printing drums 25 and 26. The roller support members 34 are supported on a pivot shaft 35 for rotational movement thereabout such that, with rotation of the roller support members 34 in a direction as shown by an arrow a in FIG. 1, the roller support members 34 are moveable between an operative, press engagement position to cause the inner press roller 33 to press an inner periphery of the screen 30, and an inoperative, wait position when the roller support members 34 are rotated in a direction as shown by an arrow b. Each of the inner press rollers 33 assumes the press engagement position during printing operation and the wait position except during printing operation.

Further, the roller support members 34 carry first and second doctor rollers 36 and 37. The first and second doctor rollers 36 and 37 include cylindrical columns, respectively, and both are located in the vicinity of the inner press roller 33. The printing ink 38 is supplied to an outer periphery space of the inner press roller 33, i.e., in an upper space surrounded between the first and second doctor rollers 36 and 37 by an ink supply section (not shown), in which an ink pool 39 is constructed. The first printing drum 25 is supplied with printing ink with a first color 38, and the second printing drum 26 is supplied with printing ink 38 with a second color.

A gap (an opposing distance) between the first doctor roller 36 and the inner press roller 33 is preset to a value sufficient to cause printing ink to be formed on the inner press roller 33, and a gap between the second doctor roller 37 and the inner press roller 33 is reduced to some extent sufficient to avoid printing ink from being leaked. That is, when the inner press roller 33 rotates, printing ink with a given thickness is continuously adhered to an outer circumferential surface of the inner press roller 33 owing to the gap between the first doctor roller 36 and the press roller 33, allowing the inner press roller 33 to supply printing ink onto the screen 30.

In addition, a print sheet clamp segment 40 is located at a given position of an outer circumferential periphery of the press drum 27, which serves as the rotary member to impart pressure for printing, thereby enabling the clamp segment to clamp an edge of the print sheet 41 which is a print medium.

PAPER FEED SECTION

The paper feed section 5 is constructed having a paper feed tray 42 on which print sheets 41 each serving as a print medium are stacked, primary paper feed rollers 43, which is kept in press engagement with an uppermost print sheet 41 stacked on the paper feed tray 42, a secondary paper feed roller pair 44 located downstream the primary paper feed rollers 43 and a guide plate pair 45 serving as a transfer guide for the print sheet between the secondary paper feed roller pair 44 and the press drum 27. Rotation of the paper feed rollers 43 causes only the uppermost print sheet 41 on the stack thereof to be transferred to the secondary paper feed roller pair 44, with the transferred print sheet 41 being fed to the printing section 4 in synchronism with the press drum 27 due to rotation of the paper feed roller pair 44.

SHEET DISCHARGE SECTION

The sheet discharge section 6 includes an upper limit guide segment 46, a sheet separator claw 47, which separates the print sheet 41 from the press drum 27 when the print sheet is not removed, a sheet discharge roller pair 48, which transfers the print sheet 41 guided by the upper limit guide 46 or separated from the sheet separator claw 47, and a paper receiving tray 49 which stacks the print sheets 41, discharged from the sheet discharge.roller pair 48, in a stacked state.

STENCIL DISPOSAL SECTIONS

The stencil disposal sections 7 are located in the frame body 8 in close proximity to the first and second printing drums 25 and 26, respectively. Each of the stencil disposal sections 7 includes a pair of stencil discharge rollers 50 and 51, which are located in the vicinity of each of the first and second printing drums 25 and 26 in a slightly spaced relationship relative to the outer peripheries thereof, a stencil guide belt 52 which guides a leading edge of the stencil sheet 11 released from the stencil clamp segment 29, a stencil discharge roller 53 which transfers the stencil sheet 11, guided with the stencil guide belt 52, while separating it from each of the first printing drum 25 and the second printing drum 26 in conjunction with the stencil discharge roller 51, a stencil disposal box 54 for receiving the stencil sheets 11 transferred from the stencil discharge rollers 51 and 53, and a stencil compressing plate 55 for compressing the stencil sheets 11 toward rearmost end of the stencil disposal box 54.

STRUCTURE OF CONTROL SYSTEM

Now, a control system for the stencil printing machine 1 is described below in detail. As shown in FIG. 2, the body frame 8 is provided with an operation panel 60. The operation panel 60 includes a stencil making/print start key, ten keys for inputting various input data such as the number of print sheets, and a display panel section for providing a display of various data (all of which are not shown).

Input data of the operation panel 60 is output to a control section 61 including a microcomputer (CPU), which controls the basic sequence of operations of the original reader section 2, the stencil making section 3, the print section 4 (including a main motor M), the paper feed section 5, the sheet discharge section 6, and the stencil disposal sections 7 located at the two positions in response to the input data.

Also, the control section 61 is applied with detection signals from an encoder 70 adapted to detect the rotational speed of the main motor M, a reference rotational position detecting sensor 71 adapted to detect a reference rotational position of the first printing drum 25, and a reference rotational position detecting sensor 72 adapted to detect a reference rotational position of the second printing drum 26, with the control section 61 being responsive to these detection signals for thereby discriminating respective rotational angular positions of the first and second printing drums 25 and 26 in a desired manner. Also, the control section 61 controls writing in or reading out of ROM 62 and a RAM 63 which store therein various control programs such that, when the print start key is depressed, control of operation is executed in a general flow diagram shown in FIG. 3. Details of control in operation will be described below.

PRINTING OPERATION AND CONTROL METHOD

Two-color printing operation of the stencil printing machine 1 will be simply described below. In the original reader section 2, the original for printing is read out, producing respective image data for the first printing color available for the first printing drum and the second printing color available for the second printing drum.

In the stencil making section 3, the elongated stencil sheet 11 is transferred with rotations of the platen roller 19 and the stencil sheet feed roller 20 to the thermal printing head 18 at which first and second stencil sheets 11 are thermally perforated, thereby producing the first and second stencil sheets 11 having first and second perforated image areas, which are formed on the basis of the image data.read out by the original reader section 2. Trailing edges of the stencil sheets 11, which have the respective perforated image areas, are cut with the stencil sheet cutter 22 for thereby forming the first and second stencil sheets 11 in a given length for printing ink with the first color specified for the first printing drum 25 and for printing ink with the second color specified for the second printing drum 26. In addition, the stencil making unit 9 is moved to the first stencil sheet supply position such that the first stencil sheet 11 formed for printing ink with the first color is supplied onto the first printing drum 25, and the stencil making unit 9 is then moved to a second stencil sheet supply position such that the second stencil sheet 111 formed for printing ink with the second color is supplied onto the second printing drum 26.

In the printing section 4, the leading edge of the first stencil sheet 11 made by the stencil making section 3 is clamped with the stencil sheet clamp segment 29 of the first printing drum 25, with the first printing drum 25 being rotated while clamping the stencil sheet such that the stencil sheet 11 is wrapped around the outer periphery of the screen 30 of the first printing drum 25. Further, the leading edge of the second stencil sheet 11, made by the stencil making section 3, is clamped with the stencil sheet clamping segment 29 of the second printing drum 26, with the second printing drum 26 being rotated while clamping the second stencil sheet such that the second stencil sheet 11 is wrapped around the outer periphery of the screen 30 of the second printing drum 26.

In the paper feed section 5, the print sheet 41 is transferred in synchronism with rotations of the first printing drum 25, the second printing drum 26 and the press drum 27, which are described below, with the leading edge of the print sheet 41 being clamped by the print sheet clamp segment 40 of the press drum 27 to allow, during rotation thereof, the print sheet 11 to be transferred between the first printing drum 25 and the press drum 27.

In the printing section 4, on the other hand, each of the inner press rollers 33 is held in the wait position, except in printing operation, wherein each inner press roller 33 is held out of press engagement with each screen 30. During printing operation, each inner press roller 33 is brought into the operative, press engagement position in each of first and second contact zones to cause each of the first and second printing drums 25 and 26 to rotate with the press drum 27. Then, each inner press roller 33 rotates on the inner periphery of each screen 30 while pressing the inner periphery of the screen 30 in the contact zone. Since, in this instance, printing ink 38 is continuously supplied onto the outer periphery of each inner press roller 33, rotation of the inner press roller 33 transfers printing ink 38 onto the screen 30.

Further, when the inner press roller 33 is brought into press engagement with the screen 30, the screen 30 associated with the inner press roller 33 is expanded toward the outer periphery thereof and is brought into press engagement with the press drum 27 in the contact zone. In addition, as previously noted above, the print sheet 41 is transferred between the first printing drum 25 and the press drum 27 from the paper feed section 5, and the transferred print sheet 41 is further continuously fed under pressure exerted by the screen 30 and the first stencil sheet 11.

Then, the print sheet 41 is transferred between the second printing drum 26 and the press drum 27, and the transferred print sheet 41 is further continuously transferred under pressure exerted by the screen 30 and the second stencil sheet 11. During consecutive transferring steps under pressed conditions, printing ink 38 with the first and second colors is consecutively transferred to the print sheet 41 via the perforated image areas of the first and second stencil sheets 11, thereby completing print in a desired image with two colors. When the leading edge of the print sheet 41 passes across a position near the inner press roller 33 associated with the second printing drum 26 and comes downstream of the above position, the print sheet clamp segment 40 is released.

In the sheet discharge section 6, the leading edge of the print sheet 41 is guided with the upper limit guide 46, or the leading edge of the print sheet 41 is separated from the press drum 27 with the sheet separator claw 47, with a subsequent transfer of the print sheet 41 to the paper receiving tray 49 via the sheet discharge roller pair 48.

In the stencil disposal section 7, further, when beginning to make new stencil sheets, the preceding stencil sheets 11, which have been wound around the outer peripheries of the respective screens 30 of the first and second printing drums 25 and 26, are released from the stencil sheet clamp segments 29 of the first and second printing drums 25 and 26, respectively, such that the released leading edges of the stencil sheets 11 are guided with the stencil guide belts 52 while rotating the first and second printing drums 25 and 26 and the stencil sheets 11 are transferred with the stencil separating roller pairs 51 and 53, respectively, allowing the stencil sheets 11 to be discharged into the stencil disposal boxes 54.

Now, the operation of the stencil printing machine will be described below in a case where a print start key is turned on with reference to FIG. 3. At step S1, when the print start key is depressed, the main motor M is driven in a manner described above to rotate the first and second printing drums 25 and 26 and the press drum 27 in synchronism with one another as shown by an arrow in FIG. 1, thereby beginning printing operation (step S2).

Here, the first and second printing drums 25 and 26 are located at rotational positions spaced from one another by a central angle of 90 degrees of the press drum 27, with the first and second printing drums 25 and 26 being rotated with a rotational phase angle of 180 degrees so as to cause respective printing positions of the first and second printing drums 25 and 26 to align with each other relative to the press drum 27. The stencil printing machine thus arranged will execute the printing operation in the same manner as discussed above and, so, a detailed description of the same is herein omitted. In step S3, when completing the printing operation with the number of print sheets which has been preset, control is executed so as to interrupt operation of the main motor M to stop rotations of the first and second printing drums 25 and 26 such that the respective stencil clamping bases 28 of the first and second printing drums 25 and 26 are left in respective stationary rest positions which are aligned in proper lateral, outward positions, as shown in FIG. 4, at which the printing operation is completed (in step S4). In FIG. 4, the stencil clamping bases 28 of the first and second printing drums 25 and 26 remain at the stationary rest positions which are located at the proper lateral positions, which are out of respective ink stain zones ISZ indicated by hatched areas and defined by vertical lines intersecting rotation centers O1 and O2, horizontal lines intersecting rotation centers O3 and O4 of the respective inner press rollers 33 and the outer circumferential peripheries of the respective printing drums 25 and 26.

The first and second printing drums 25 and 26 are left at the respective rest positions until the next printing or stencil making operations begin to be executed. At the termination of the printing operation, the printing ink 38 is liable to drop while gradually flowing downward on the outer peripheries of the inner press rollers 33 in a long time period. Since, in this instance, the stencil clamping bases 28 of the first and second printing drums 25 and 26 are not located on a traveling path of the printing ink 38, there exists less possibilities wherein the printing ink 38 flows through a gap between the stencil clamping base 28 and the screen onto a surface of the stencil clamping base 28, resulting in less stains with printing ink in the stationary rest positions of the first and second printing drums 25 and 26.

OTHER PREFERRED EMBODIMENTS

The rotational angular positions of the first and second printing drums 25 and 26 may be controlled so as to lie on laterally inward positions, as shown in FIG. 5, at the termination of the printing operation, thereby proving the same effect and advantage as those discussed above.

Also, in this preferred embodiment, although the rotations of the first and second printing drums 25 and 26 are arranged to stop at given rotational angular positions such that the respective stencil clamp bases 28 are located at proper lateral positions, the first and second printing drums 25 and 26 may be stopped at given rotational positions such that, when the first and second printing drums 25 and 26 are partitioned from one another by vertical lines lying on the rotation centers O1 and O2 of the first and second printing drums 25 and 26, both the respective stencil clamp bases 28 remain in areas except given zones L1 and L2 in which the inner press rollers 33 are located, respectively, and which are defined below horizontal lines H1 and H2 intersecting the rotation centers O3 and O4 of the respective inner rollers 33 (see FIG. 4).

However, as in the preferred embodiment discussed above, when the respective stencil clamp bases 28 of the first and second printing drums 25 and 26 are stopped at the proper lateral positions, both the first and second printing drums 25 and 26 are stopped at the given rotational angular positions, which remain at the same height, thereby minimizing possibilities in which the printing ink is caused to flow through the gap between and stencil clamp base 28 and the screen 30 onto the surface of the stencil clamp base 28.

While, in the above illustrated embodiments, the stencil printing machine 1 has been described as having two printing drums 25 and 26 located in close proximity to a single press drum 27, the present invention may also be applied in a substantially similar manner to a printing machine in which three printing drums are located in close proximity to the single press drum. Also, although the present invention has been described with respect to a printing machine wherein the first and second printing drums 25 and 26 are located in close proximity to the outer circumferential periphery of the press drum 27 at angular positions shifted by 90 degrees of the central angle of the press drum 27, the present invention may also be applied to the printing machine wherein the first and second printing drums 25 and 26 are located in close proximity to the outer periphery of the press drum 27 in areas except the positions lying on the central angle of 90 degrees of the press drum 27. In this event, assuming that the central angle of the press drum 27 is .theta. since both the first and second printing drums 25 and 26 are rotated while keeping a rotational phase angle of 2. theta. (equal to an angle except 180 degrees), the rotational stop positions of both the first and second printing drums 25 and 26 may be located at upper positions higher than the lateral positions.

The stencil printing machine and control method of the same provides numerous advantages over earlier practices which include:

(A) Unlike the earlier practices which need troublesome works prior to beginning the printing operations, the stencil printing machine and the control method will normally require to merely turn on the print start key on the operation panel and, without any troublesome works, ensure that the print medium is not stained with ink even when the trailing edge of the print medium is brought into contract with either one of the stencil clamping bases of the printing drums during the printing operation. More particularly, at the termination of the printing operation, the stencil clamping bases of the plural printing drums are forcibly stopped at respective stationary rest positions which are out of respective ink stain causing zones defined by the vertical lines intersecting the rotation centers of the respective printing drums, the horizontal lines intersecting the rotation centers of the respective inner press rollers located inside the respective printing drums and the outer circumferential peripheries of the respective printing machines. With such a feature, even when, at the termination of the printing operation, the printing ink gradually flows downward along the outer circumferential walls of the respective inner rollers, the printing ink is prevented from entering or flowing out from the gap between the ink permeable members and the associated stencil clamping bases, thereby effectively preventing the printing drums from being stained with the printing ink in their non-printing conditions.

(B) When the plural printing drums are constructed of two printing drums, the two printing drums are rotated with the rotational phase angle of 180 degrees and are arranged such that both the two printing drums are stopped at their respective stationary rest positions, at the termination of the printing operation, which are aligned on the proper lateral positions at which the stationary rest positions of the two printing drums remain at the same height. As a consequence, it is highly reliable to equally minimize the possibilities wherein the printing ink flows through the gaps between the stencil clamping bases and the associated ink permeable members of the two printing drums and flows out onto the surfaces of the respective stencil clamping bases.

The foregoing description of the preferred embodiments of the invention has been presented to illustrate the principles of the invention and not to limit the invention to the particular embodiments illustrated. For example, in the illustrated embodiments, although the stencil clamping bases of plural printing drums have been shown as being located at respective stationary rest positions aligned on the proper lateral positions, the stencil clamping bases of the respective printing drums may not necessarily be stopped at the proper lateral positions but may be stopped at other remaining positions outside the ink stain zones.

What is claimed is:

1. A stencil printing machine comprising:

a frame body;

a press drum rotatably supported in the frame body;

a plurality of printing drums rotatably supported in the frame body in close proximity to the press drum and each including an outer circumferential periphery having a first portion formed with a stencil clamping base having a stencil clamping segment and a second remaining portion formed with an ink permeable member;

a plurality of ink supply rollers located inside the printing drums, respectively, for supplying ink to respective inner peripheral surfaces thereof;

wherein, during printing operation, the plurality of printing drums are rotated with a given rotational phase angle relative to the press drum, and the ink supply rollers are rotated to supply ink to the inner peripheral surfaces of the respective printing drums; and wherein, at termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

2. A stencil sheet according to claim 1, wherein the plurality of printing drums include two printing drums which are rotated with the rotational phase angle of 180 degrees, and wherein, at the termination of printing operation, both the stationary rest positions of the respective printing drums are aligned in proper lateral locations.

3. A stencil printing machine according to claim 1, further comprising:

a main motor for driving the press drum and the printing drums with the given rotational phase angle;

a rotation sensor for detecting a rotational position of the main motor to produce a rotational position signal;

rotational reference position sensor means for detecting rotational reference positions of the printing drums for producing rotational reference position signals representing rotational reference positions of the printing drums, respectively; and control means for controlling the main motor responsive to the rotational position signal and the rotational reference position signals such that, during printing operation, the printing drums are rotated with the given rotational phase angle, and such that, at the termination of printing operation, the printing drums are stopped at the respective angular positions.

4. A stencil printing machine comprising:

a frame body;

a press drum rotatably supported in the frame body;

a plurality of printing drums rotatably supported in the frame body in close proximity to the press drum and each including an outer circumferential periphery having a first portion formed with a stencil clamping base having a stencil clamping segment and a second remaining portion formed with an ink permeable member;

a stencil making unit supported in the frame body for making stencil sheets each having a perforated image area formed on the basis of a color original, with the stencil sheets being supplied to and mounted onto the outer circumferential peripheries of the respective printing drums;

a plurality of ink supply rollers located inside the printing drums, respectively, for supplying ink to respective inner peripheral walls thereof;

wherein, during printing operation, the plurality of printing drums are rotated with a given rotational phase angle relative to the press drum, and the ink supply rollers are rotated to supply ink to the inner peripheral walls of the respective printing drums; and wherein, at termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

5. A stencil sheet according to claim 4, wherein the plurality of printing drums include two printing drums which are rotated with the rotational phase angle of 180 degrees, and wherein, at the termination of printing operation, both the stationary rest positions of the respective printing drums are aligned in proper lateral locations.

6. A stencil printing machine according to claim 4, further comprising:

a main motor for driving the press drum and the printing drums with the given rotational phase angle;

a rotation sensor for detecting a rotational position of the main motor to produce a rotational position signal;

rotational reference position sensor means for detecting rotational reference positions of the printing drums for producing rotational reference position signals representing rotational reference positions of the printing drums, respectively; and control means for controlling the main motor responsive to the rotational position signal and the rotational reference position signals such that, during printing operation, the printing drums are rotated with the given rotational phase angle, and such that, at the termination of printing operation, the printing drums are stopped at the respective angular positions.

7. A method of controlling a stencil printing machine having a press drum rotatably supported in a frame body, a plurality of printing drums rotatably supported in the frame body in close proximity to the press drum and each including an outer circumferential periphery having a first portion formed with a stencil clamping base having a stencil clamping segment and a second remaining portion formed with an ink permeable member, and a plurality of ink supply rollers located inside the printing drums, respectively, for supplying ink to inner peripheral walls of the respective printing drums, and a main motor for driving the press drum and the plurality of printing drums, the method comprising:

rotating the plurality of printing drums with the main motor with a given rotational phase angle relative to the press drum;

making stencil sheets each having a perforated image area formed on the basis of an original; mounting the stencil sheets onto the printing drums;

supplying ink to the plurality of printing drums; and supplying a print medium between the printing drums and the press drum to allow ink to be transferred from the printing drums through the perforated image areas thereof to the print medium to reproduce a desired image thereon;

wherein, at termination of printing operation, the printing drums are kept in respective stationary rest positions wherein the stencil clamping bases of the respective printing drums are out of respective ink stain zones defined by vertical lines intersecting rotation centers of the respective printing drums, horizontal lines intersecting rotation centers of the respective ink supply rollers and the outer circumferential peripheries of the respective printing drums.

8. A method according to claim 7, wherein the plurality of printing drums include two printing drums which are rotated with the rotational phase angle of 180 degrees, and wherein, at the termination of printing operation, both the stationary positions of the respective printing drums are aligned in proper lateral locations.

9. A method according to claim 7, further comprising:

rotating the press drum and the printing drums with the given rotational phase angle;

detecting a rotational position of the main motor to produce a rotational position signal;

detecting rotational reference positions of the printing drums for producing rotational reference position signals representing rotational reference positions of the printing drums, respectively; and controlling the main motor responsive to the rotational position signal and the rotational reference position signals such that, during printing operation, the printing drums are rotated with the given rotational phase angle, and such that, at the termination of printing operation, the printing drums are stopped at the respective stationary rest positions.

* * * * *